United States Patent [19]

Bielka

[11] Patent Number: 4,967,574

[45] Date of Patent: Nov. 6, 1990

[54] ANIMAL FORM PENDANT WITH CONCEALED JOINT CONNECTION

[76] Inventor: Robert B. Bielka, 317 E. 75th St., New York, N.Y. 10021

[21] Appl. No.: 333,097

[22] Filed: Apr. 3, 1989

[51] Int. Cl.[5] ..... A44C 25/00

[52] U.S. Cl. ..... 63/23; 63/2

[58] Field of Search ..... 63/23, DIG. 3, 2; 29/160.6

[56] References Cited

U.S. PATENT DOCUMENTS

| | | | |
|---|---|---|---|
| 942,524 | 12/1909 | Sneyd | 63/23 |
| 4,512,748 | 4/1985 | Matsumoto et al. | 63/23 X |
| 4,581,904 | 4/1989 | Lehmann et al. | 63/23 |

*Primary Examiner*—Laurie K. Cranmer
*Attorney, Agent, or Firm*—Robert J. Hess

[57] ABSTRACT

A charm having a body wall, an extremity, a pin secured to an inner surface of the extremity and extending through the body wall, and a retaining ring secured tightly against the body wall and being around the pin. The extremity is thereby rotatably connected to the body wall by having its open end pressed against an outside flat of the body wall while the retaining ring is pressed against an inside flat of the body wall. Both flats are parallel to each other. The pin projects perpendicular to a plane which passes through a longitudinal edge of the open end. Excess play between the extremity and the body wall is eliminated by forcibly shifting the pin perpendicular to an axis of rotation of the extremity.

17 Claims, 1 Drawing Sheet

ANIMAL FORM PENDANT WITH CONCEALED JOINT CONNECTION

FIELD OF THE INVENTION

The present invention relates to a concealed joint connection for an animal form pendant or charm. The joint connection is between a main body and an extremity of the pendant and enables the extremity to rotate relative to the main body.

BACKGROUND OF THE INVENTION

Animal form pendants or charms (hereinafter referred to as "animal charms") made out of precious metals are known. Such charms generally have extremities which are either solid or hollow. The hollow extremities are easier to cast and require less material. Since such animal charms are made out of precious metals such as gold or platinum, savings in material is an important economic consideration.

The connection between the main body of the animal charm and its extremities enables relative rotation therebetween. Further, rotation of the "leg" extremities of the animal charm should enable the animal charm to stand up in one position and sit down in another position without toppling over in either position. Therefore, the connection between the main body and the extremities can not allow too much play or the animal charm will not stay balanced and will topple over. Also, too much play can result in gaps opening at the joint making the joint look weak.

Where the extremity is solid, an end of a pin is welded to the center of a flat face of the extremity. Where the extremity is hollow, an end of a pin is soldered into a hole in a spanning bar that extends across the open end of the hollow extremity. In both cases, the opposite end of the pin is then inserted through a hole in a flat outer surface portion of the main body and into the hollow of the main body. This opposite end of the pin is then further inserted through the center opening of a retaining ring. The retaining ring has a greater outer diameter than the hole in the body through which the pin is inserted. The retaining ring is then soldered in place on the pin. Thus, one end of the pin is secured to the extremity and the opposite end of the pin is secured to the retaining ring. If all went well, the extremity would be rotatable relative to the main body at the joint therebetween.

However, assembly did not always go so smoothly due to the close proximity of the soldering points. There are two solders which secure opposite ends of the spanning bar to the open end of the extremity next to the main body. Another solder secures the one end of the pin to the central hole in the spanning bar which is also next to the main body. All these solders are so close to the main body that soldering the retaining ring to the inside of the flat of the main body in the final step can easily heat the other solders to the point where they flow onto the main body. This results in the joint between the main body and extremity becoming immobile due to this fusing together of the main body and extremity.

The spanning bar complicates the assembly procedure. The shape and size of the spanning bar varies depending upon the extremity for which it is to be used. Thus, each spanning bar must be separately identified prior to assembly to avoid confusion. Each spanning bar must be grated in its own right direction so that it will be in properly positioned across the respective open end of the extremity to enable insertion of a pin into the hole in the correct alignment.

Further, the spanning bar must be properly oriented across the open end of the extremity so that the pin will be inserted precisely into the hole. Any slight deviance in the alignment will require that the spanning bar be completely repositioned, thereby requiring further soldering. There is no easy way to adjust the spanning bar after it has been misaligned.

In order to facilitate positioning of the spanning bar, notches are made into the inner surface of the extremity at the open end. If the spanning bar is misaligned, all the solder must also be cleaned out of the notches before trying to position the spanning bar into a correct alignment.

If the joint has too much play after assembly, the joint must be disassembled and repositioned. Too much play can also arise over time, due to wear and tear. It can also arise due to the setting of precious stones, polishing, etc. With too much play, the joint will be freely rotatable of its own accord so that the extremities do not remain in desired positions but rather rotate freely due to gravity relative to the main body.

It would therefore be desirable to reduce labor and material costs in the assembly of the animal form charm by eliminating the spanning bar from the connection system and thereby reduce the likelihood of accidental fusing together of the main body and extremities as well. It is also desirable to eliminate excess play in the joint without disassembling the joint.

SUMMARY OF THE INVENTION

The present invention is directed to an animal form charm having a hollow main body, a hollow extremity with an open end, and a rotatable joint connection between the main body and the extremity. The rotatable joint connection includes an elongated pin having a first end secured to an inner surface of the extremity. The pin extends along the axis of rotation of the extremity and through a hole in the outer surface of the main body. A second end of the pin is retained from the inside of the main body so that the second end does not pass through the hole again and the extremity is tightly held against the main body.

Preferably, the pin is deformable so that if the need arises to reduce the amount of play in the joint, the extremity can be forcibly shifted in a direction perpendicular to the axis of rotation of the extremity so as to deform the pin. If the pin is straight and not deformed, it will span from its attachment area on the inner wall of the extremity to the hole in the main body by a certain distance. By deforming the pin transversely by the forcibly shifting procedure, this distance is shortened in that a deformed pin can not extend as far as can a straight pin. In this manner, excess play is taken up and eliminated.

Another aspect of the present invention resides in a method of making an animal form charm by securing a first end of a pin to an inner surface of a hollow extremity so that the pin projects out of the extremity through an open end of the extremity perpendicular to the plane of the open end. The projected portion of the pin is then inserted through a hole in a flattened outer surface of the main body. The second end of the pin is then retained from inside the main body so that it can not be passed back through the hole. Preferably, a retaining ring is soldered to the second end of the pin. The retaining ring has a diameter greater than the diameter of the hole through surface of the main body.

For a better understanding of the preferred embodiment of the present invention, reference is made to the accompanying drawings in the description below and the scope of the invention is set forth in the appended claims.

DESCRIPTION OF THE PREFERRED EMBODIMENT

Figure 1:
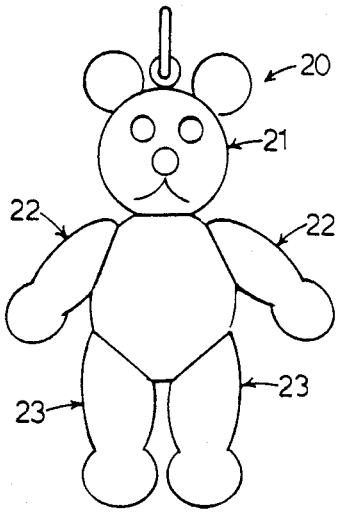
FIG. 1 is a top plan view of an animal charm in accordance with the present invention.
Figure 2:
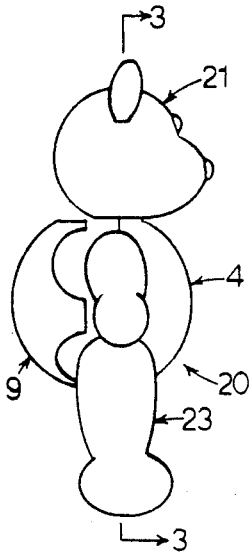
FIG. 2 is a partially exploded side view of FIG. 1.

Turning to FIGS. 1 and 2, an assembled animal charm 20 is shown that has a main body 4 and extremities 1, which include a head 21, arms 22 and legs 23. The main body 4 and extremities 1 each have outer flat surfaces which contact each other. A back cover 9 can be seen in FIG. 2. Both the main body 4 and the extremities 1 are hollow.

Figure 3:
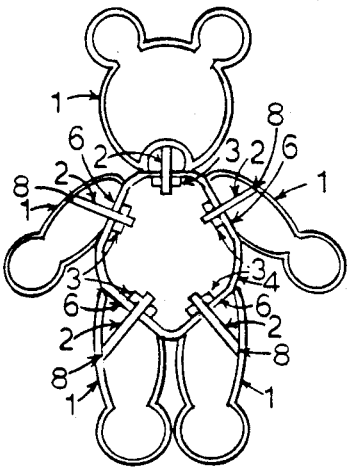
FIG. 3 is a cross-section taken across section lines 3—3 of FIG. 2.

FIG. 3 shows the inside of the assembled animal charm 20. Each of the extremities 1 has an open end 5 and an inside wall 11. Each of the extremities 1 is rotatably connected the main body 4 against a flat 6 of the main body 4. Pins 2 extend through the respective flats 6 with one end secured to the inside wall 11 of the respective extremity at area 8 and with the other end secured to a respective retaining ring 3, which retains the extremity 1 to the main body 4.

Figure 4:
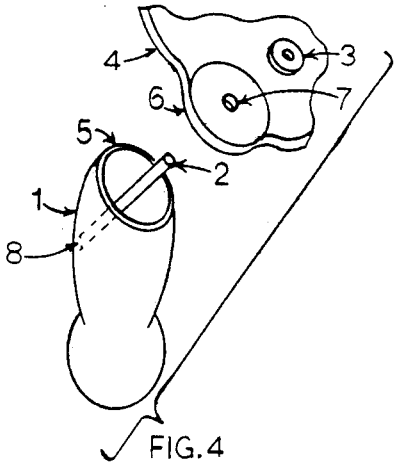
FIG. 4 is a broken exploded perspective view of a portion of the animal charm in accordance with the present invention.

FIG. 4 is an exploded view which is helpful in illustrating the assembly procedure. First, an end of the pin 2 is welded or soldered to an inner wall 11 of the extremity 1 at area 8 so that the pin 2 protrudes through the open end 5 perpendicular to a plane passing through the longitudinal edges which define the open end 5.

The pin 2 is then inserted through the hole 7 in the flat 6 of the main body 4 until the open end 5 of the extremity 1 fits tight against the inside of flat 6 on the main body 4. A retaining ring 3 is pushed onto the pin 2 tight against the inside of flat 6 and welded or soldered onto the pin 2. This secures the extremity 1 onto the body 4 while allowing the extremity to be rotatable relative to the main body 4 about the axis of the pin 2. The retaining ring 3 is ideally suited for retaining because it will exert a force evenly radially outward. After welding or soldering all the retaining rings 3 onto respective pins 2 of respective extremities 1, the back cover 9 is then welded to close the back opening in the main body 4 so that the retaining rings 3 are completely concealed in the main body 4.

While it is preferred to make the entire charm out of precious metals, the aforementioned joint connection could very easily be made out of cheaper materials since it will be entirely concealed when the charm is fully assembled and thereby not visible to the wearer. The only requirement is that whatever material is selected for the joint connection, it must be such that it will not react with the precious metal material over time.

The retaining ring could be an elastic sleeve instead of being made of precious metal. The end of the pin which projects inside of the main body is then bent so that the elastic retaining ring compresses between the bent portion of the pin and the inside of the flat 6 of the main body 4. The end of the bent portion of the pin is then welded to the inside of the flat 6.

Optionally, the end of the bent portion is not welded at all, provided the pin is permanently deformed such that it will not bend back under pressure from the compressed elastic retaining ring. This option eliminates the need for a soldering point at the inside of the flat 6.

In both cases, the elastic retaining ring is under compression so that a continuous force acts to keep the open end 5 of the extremity 1 against the outside of flat 6. This force compensates for any play which may arise, thereby preventing excess play from ever arising. Wear and tear at the joint due to relative rotation of the extremity 1 and the body 4 is continuously compensated by action of the elastic force of the retaining ring. This elastic force is in a longitudinal direction and arises due to the tendency for the elastic retaining ring to leave its compressed state to return to an uncompressed state. Instead of bending the pin 2, an additional member such as a ring can be secured to the end of the pin so as to keep the elastic retaining ring under compression.

The pin 2 and retaining ring 3 could also be made out of a single piece. Positioning would require inserting the opposite end of the pin (i.e., the end which is away from the retaining ring) through the hole 7 and then welding or soldering this opposite end to the inner surface 11 of the extremity at area 8. Access to area 8 to effect welding of this opposite end of the pin 2 is a problem and would require opening the extremity nearby to gain access. This creates an undesirable break in the extremity surface which is soldered closed, leaving a mark on the outer surface of the extremity. It is therefore preferred to keep the pin 2 and the retaining ring 3 separate until after a pin end is soldered into position at area 8 and the opposite end of the pin is inserted through the hole 7.

As depicted in FIG. 3, the attachment of the pin 2 to the head differs from that for the arms and legs insofar as the attachment is to an outer surface rather than to an inner surface. The head has a first outer wall portion against the body wall and a second outer wall portion which is curved to extend inward from and relative to the first outer wall portion in a direction toward the enclosed space within the head. The pin is secured to this second outer wall portion.

Figure 5:
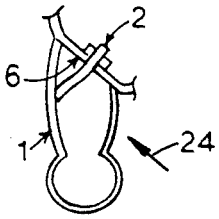
FIG. 5 is a cross-section of a portion of FIG. 3, but showing the pin forcibly shifted.

In the event that there is play between the flat 6 and open end 5 of the extremity after assembly, the pin 2 may be forcibly shifted transversely of the axis of rotation of the limb in the direction of the arrow shown in FIG. 5 to bend the pin as shown.

While the invention has been illustrated and described as an animal form pendant, it is understood that other shapes, modifications and constructions may be made without departing from the spirit of the present invention.

I claim:

1. A charm, comprising a body wall having a first side and a second side; an extremity having an inner surface enclosing a space and having an open end, said open end being against said first side; and means for rotatably connecting said extremity to said body wall so as to enable said extremity to rotate relative to said body wall, said rotatably connecting means including an elongated pin extending through said body wall, said rotatably connecting means also including means for retaining said open end against said first side, said retaining means being against said second side and extending outward from said pin, said rotatably connecting means also including means for securing a first end of said pin to said inner wall of said extremity.

2. A charm as defined in claim 1, wherein said retaining means includes a retaining ring and means for securing said retaining ring to said second side.

3. A charm as defined in claim 1, further comprising: a body enclosing a hollow space by said body wall, said first side being an outer surface of said body and said second side being an inner surface of said body, said body concealing said retaining means from view.

4. A charm as defined in claim 3, further comprising a plurality of extremities, said rotatably connecting means respectively connecting each of said extremities to said body wall.

5. A charm as defined in claim 4, wherein extremities include two arm-shaped elements and two leg-shaped elements.

6. A charm as defined in claim 1, wherein said body and said extremity are made from precious metals.

7. A charm as defined in claim 1, wherein said retaining means includes a compressed elastic member which exerts a force against said body wall.

8. A charm as defined in claim 1, wherein said first side and said second side are planar surfaces parallel to each other.

9. A charm as defined in claim 1, wherein said open end has a longitudinal edge through which passes a plane, said pin protruding perpendicular to said plane.

10. A charm as defined in claim 1, wherein said pin is deformable in response to a force being applied against said pin in a direction that is perpendicular to an axis of rotation of said extremity.

11. A charm as defined in claim 1, further comprising:

a head extremity having a first outer wall portion against said body wall and having a second outer wall portion extending from said first outer wall portion and away from said body wall; and second means for rotatably connecting said head extremity to said body wall, said second means including a second pin extending through said body wall, means for retaining said second pin against said second side of said body wall, and means for securing said second pin to said second outer wall portion.

12. A method of making a charm, comprising the steps of securing an end of an elongated pin to an inner surface of an extremity, the inner surface of the extremity enclosing a space, the extremity having an open end; inserting an opposite end of the pin through a body wall having a first side and a second side; and retaining the open end against the first side of the body wall by extending a retaining member outward from the pin and against the second side of the body wall to thereby rotatably connect the extremity to the body so as to enable the extremity to rotate relative to the body wall.

13. A method as defined in claim 12, wherein the step of securing includes securing the end of the pin so that the pin projects through the open end perpendicular to a plane passing through a longitudinal edge of the open end.

14. A method as defined in claim 12, wherein the step of retaining includes securing the retaining member to the second side of the body wall.

15. A method as defined in claim 12, further comprising the step of concealing the retaining member in a body having the body wall.

16. A method as defined in claim 12, further comprising the step of eliminating excess play by forcibly shifting the pin in a direction perpendicular to an axis of rotation of the extremity.

17. A method as defined in claim 12, wherein the step of retaining includes compressing the retaining member against the body wall so as to apply a continuous pressure which causes the extremity to remain against the body wall.

* * * * *